US006988542B2

(12) United States Patent
Hughes et al.

(10) Patent No.: US 6,988,542 B2
(45) Date of Patent: Jan. 24, 2006

(54) HEAT EXCHANGER

(75) Inventors: Gregory G. Hughes, Milwaukee, WI (US); Jianmin Yin, Kenosha, WI (US)

(73) Assignee: Modine Manufacturing Company, Racine, WI (US)

( * ) Notice: Subject to any disclaimer, the term of this patent is extended or adjusted under 35 U.S.C. 154(b) by 238 days.

(21) Appl. No.: 10/360,071

(22) Filed: Feb. 6, 2003

(65) Prior Publication Data

US 2004/0154787 A1 Aug. 12, 2004

(51) Int. Cl.
*F28D 7/10* (2006.01)

(52) U.S. Cl. ..... 165/164; 165/109.1; 165/156; 165/176

(58) Field of Classification Search ..... 165/156, 165/163, 164
See application file for complete search history.

(56) References Cited

U.S. PATENT DOCUMENTS

| | | | | |
|---|---|---|---|---|
| 2,611,585 A | | 9/1952 | Boling | |
| 2,820,615 A | | 1/1958 | Peters | |
| 2,844,360 A | | 7/1958 | Buri | |
| 3,253,326 A | | 5/1966 | Henry et al. | |
| 3,976,129 A | | 8/1976 | Silver | |
| 4,304,292 A | * | 12/1981 | Cardone et al. | 165/47 |
| 4,347,894 A | | 9/1982 | Gerlach | |
| 4,466,567 A | | 8/1984 | Garrison | |
| 4,488,513 A | | 12/1984 | Jahnke et al. | |
| 4,593,753 A | * | 6/1986 | McConnell | 165/51 |
| 4,798,241 A | * | 1/1989 | Jarrett et al. | 165/109.1 |
| 4,858,584 A | | 8/1989 | Bridgeman | |
| 4,872,503 A | | 10/1989 | Marriner | |
| 5,050,670 A | | 9/1991 | Bronnert | |
| 5,163,509 A | | 11/1992 | Dawson | |
| 5,213,156 A | | 5/1993 | Eriksson | |
| 5,339,654 A | | 8/1994 | Cook et al. | |
| 5,379,832 A | | 1/1995 | Dempsey | |
| 5,487,423 A | | 1/1996 | Romero | |
| 5,497,824 A | * | 3/1996 | Rouf | 165/184 |
| 2004/0159110 A1 | * | 8/2004 | Janssen | 62/77 |

FOREIGN PATENT DOCUMENTS

| | | |
|---|---|---|
| DE | 202 14 546 U 1 | 11/2002 |
| EP | 0 722 075 A1 | 7/1996 |
| FR | 1409447 | 8/1965 |
| JP | 2001280862 | 10/2001 |

OTHER PUBLICATIONS

PCT International Search Report.

* cited by examiner

*Primary Examiner*—Allen J. Flanigan
(74) *Attorney, Agent, or Firm*—Wood, Phillips, Katz, Clark & Mortimer

(57) ABSTRACT

A heat exchanger specifically intended to act as a water heater by heating water utilizing heat rejected from a gaseous refrigerant in a refrigeration system includes first and second, generally parallel, spaced tubular water headers (10,12) with a plurality of water tubes (14) extending in spaced relation between the water headers (10,12) and in fluid communication therewith. An inlet (16) is provided to one of the headers (10) and water outlets (20,28,30) are provided from at least one of the water headers (10,12). A plurality of gas tubes (32), at least one for each water tube (14), are helically wound about a corresponding one of the water tubes (14) and have opposed ends (34,36) connected to respective ones of first and second, generally parallel, spaced gas headers (40,42).

21 Claims, 3 Drawing Sheets

HEAT EXCHANGER

FIELD OF THE INVENTION

This invention relates to heat exchangers generally, and more particularly, to a heat exchanger that may serve as a water heater and a gas cooler.

BACKGROUND OF THE INVENTION

Ozone layer and/or global warming problems have focused considerable attention on the nature of refrigerants employed in refrigeration systems of various sorts. Some such systems, particularly those that do not have sealed compressor units as are commonly found in vehicular air conditioning systems, are prone to refrigerant leakage. Older refrigerants, HFC 12, for example, are thought to cause depletion of the ozone layer while many of the replacements, HCFC 134a, for example, are believed to contribute to the so-called "greenhouse effect" and thus global warming.

As a consequence, a considerable effort is underway to develop refrigeration systems employing transcritical refrigerants such as carbon dioxide. Carbon dioxide is plentiful in the atmosphere and may be obtained therefrom by conventional techniques and employed as a refrigerant in such systems. Should the systems leak the $CO_2$ refrigerant, because it was originally obtained from the atmosphere, there is no net increase of the refrigerant in the atmosphere, and thus no increase in environmental damage as a result of the leak.

Transcritical refrigeration systems, such as $CO_2$ systems, operate at relatively high pressures and require, in lieu of a condenser in a conventional vapor compression refrigeration system, a gas cooler for the refrigerant.

The heat rejected by a gas cooler can be employed for various useful purposes and one such use is for heating potable water for residential, commercial, or industrial usages. The present invention is primarily directed at providing a combination water heater and gas cooler.

SUMMARY OF THE INVENTION

It is the principal object of the invention to provide a new and improved heat exchanger. More specifically, it is an object of the invention to provide a new and improved heat exchanger that can be used with efficacy in a refrigeration system for cooling gaseous refrigerant while heating potable water.

An exemplary embodiment of the invention achieves the foregoing object in a heat exchanger intended for use as a water heater/gas cooler that includes first and second generally parallel, spaced, tubular water headers. A plurality of water tubes extend in spaced, generally parallel relation between the water headers and are in fluid communication therewith. A water inlet is provided in one of the water headers and a water outlet is provided in one of the water headers.

A plurality of gas tubes, at least one for each water tube, are helically wound about corresponding ones of the water tubes in heat transfer facilitating contact therewith and each gas tube has opposed ends. First and second, generally parallel spaced gas headers are connected in fluid communication with the respective ones of the opposed ends of the gas tubes and a gas inlet is provided in one of the gas headers and a gas outlet is provided in the other of the headers.

In a preferred embodiment, there is at least one additional outlet in one of the water headers.

A preferred embodiment also contemplates that there may be at least one baffle in at least one of the water headers.

In one embodiment of the invention, a non-straight turbulator wire is disposed in the water tubes. More preferably, the turbulator wire is a helical or spirally shaped wire.

One embodiment of the invention contemplates that the water tubes are generally straight and the water headers are remote from one another.

In another embodiment of the invention, the water tubes are bent to bring the water headers into proximity to one another.

One embodiment of the invention contemplates that the tubes be formed of a metal selected from the group that consists of copper and stainless steel.

In one embodiment of the invention, the interior of the water tubes is grooved.

One embodiment of the invention contemplates that the exteriors of the water tubes have helical grooves and that the gas tubes are wound in the grooves.

In a preferred embodiment, each gas tube includes an inside diameter in the range of about 0.04 inches to 0.10 inches and is helically wound to a pitch in the range of about 0.20 inches to 2.0 inches.

In a highly preferred embodiment, the inside diameter of the gas tubes is about 0.08 inches and the pitch is about 0.30 inches.

A preferred embodiment of the invention contemplates that the water tubes have an inside diameter in the range of about 0.10 inch to 0.50 inches.

According to the embodiment mentioned immediately preceding, the water tubes include a helical internal spring wire turbulator having a diameter in the range of about 0.03 inches to 0.08 inches and a pitch in the range of about 0.20 inches to 1.0 inches and the water tube inner diameter is in the range of about 0.10 inches to about 0.40 inches.

In this embodiment, it is preferred that the water tubes be smooth walled.

In another embodiment of the invention, the water tubes each have a helical groove in which a corresponding one of the gas tubes is snugly received and each helical groove has a pitch in the range of about 0.20 inches to 2.0 inches. More preferably, the internal diameter of this embodiment of the water tubes is in the range of about 0.14 inches to 0.50 inches and includes a grooved inner wall surface.

Other objects and advantages will become apparent from the following specification taken in connection with the accompanying drawings.

DESCRIPTION OF THE PREFERRED EMBODIMENTS

The present invention will be described as being useful in the environment of a refrigeration system employing a transcritical refrigerant such as $CO_2$. However, it is to be understood that the heat exchanger may be used in other heat exchange applications that do not involve refrigeration and/or water heating and may find use in refrigeration systems using nontranscritical and/or conventional refrigerants. Accordingly, no limitation to a water heater/gas cooler in a transcritical refrigeration system is intended except insofar as expressly stated in the appended claims.

Figure 1:
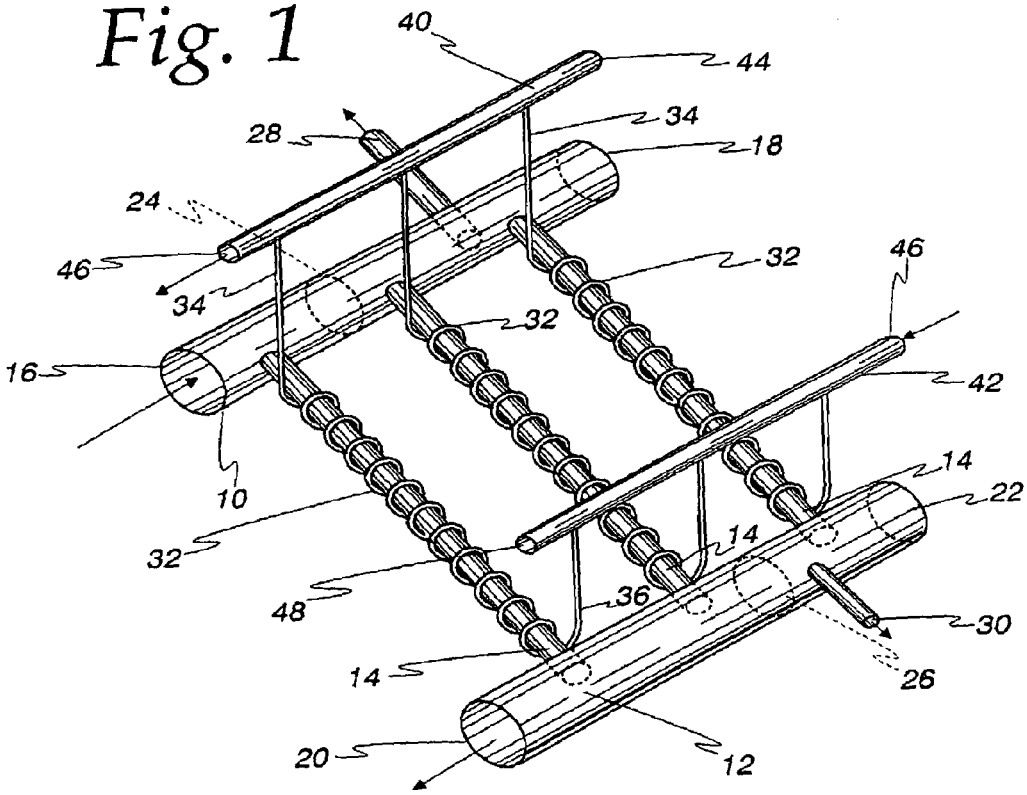
FIG. 1 is a perspective view of one embodiment of a heat exchanger made according to the invention.

Referring to FIG. 1, a heat exchanger made according to the invention includes a pair of spaced, cylindrical, tubular headers, 10 and 12, which are generally parallel to one another. Smaller diameter cylindrical, water tubes 14 extend between the headers 10,12 and are in fluid communication with the interior thereof.

In the embodiment illustrated in FIG. 1, the header 10 has an inlet at an end 16 with the opposite end 18 being plugged by any suitable means. The header 12 includes an outlet 20 with the opposite end 22 being suitably plugged. However, desired, a so-called multipass unit can be utilized wherein both the inlet 16 and outlet 20 are in the same header 10 or 12 with the passage of water through the tubes 14 being caused to occur in a serial fashion as by the conventional use of interior baffles 24 and 26 respectively, in the headers 10,12, as shown in FIG. 1. However, it is to be specifically noted that either or both of the baffles 24 and 26 are purely optional and if desired, flow through each of the tubes 14 could be in a hydraulically parallel fashion or, in some instances, could be a combination of hydraulically parallel and hydraulically serial flow, as desired.

Regardless of the particular flow pattern used, the invention contemplates that one or both of the headers 10 and 12 may be provided with at least one outlet in addition to the outlet 20 from the header 12. Thus, an outlet conduit 28 is located in the header 10 between the baffle 24 and the end 18 while a similar outlet conduit 30 is located in the header 12 between the baffle 26 and the outlet 20. The additional outlets provide a means whereby water flowing through the tubes 14 may be outletted to a point of use at different temperatures. For example, when the baffles 24 and 26 are present, water passing to the outlet 30 will pass through all three runs of the tubes 14 illustrated and thus be more subjected to heating than water passing to the outlet 28 which only passes through two of the tubes 14 which, in turn, will be hotter than water passing out of the outlet 20 which has passed through only one of the tubes 14.

The heating of the water in the tubes 14 is obtained by wrapping a cylindrical tube 32 of smaller diameter than the tubes 14 about each of the tubes 14. Each of the helical tubes 32 is wrapped tightly about the corresponding tube 14 to be in good heat transfer contact therewith and preferably, will be metallurgically bonded to the associated water tube 14 by brazing or soldering.

The tubes 32 are gas tubes with opposed ends 34 and 36 adjacent, respectively, the headers 10 and 12. The ends 34 extend to and are in fluid communication with a gas header 40 while the ends 36 extend to and are in fluid communication with the interior of a second gas header 42 which is spaced from and parallel to the header 40. The header 40 is capped at an end 44 and thus the opposite end 46 provides a gas outlet where countercurrent flow is desired in the case where the baffles 24 and 26 are omitted. The gas header 42 has an open end 46 which serves as an inlet and a capped end 48.

Figure 2:
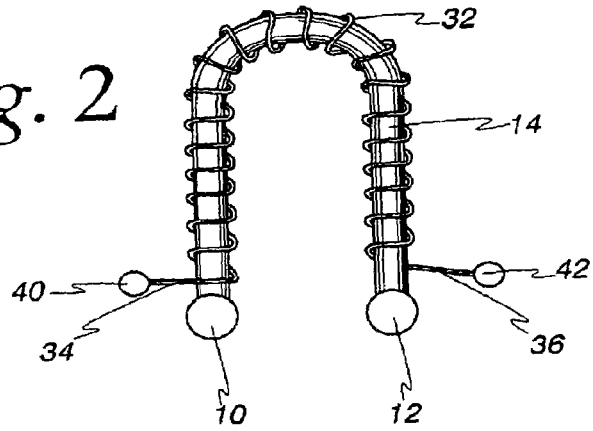
FIG. 2 is a side elevational of an alternative embodiment.

In the embodiment illustrated in FIG. 1, the water tubes 14 are straight tubes. However, in some cases, for spatial reasons, the tubes 14 may be bent intermediate their ends to be, for example, U-shaped as illustrated in FIG. 2 to bring the headers 10 and 12 into proximity with one another.

Figure 3:
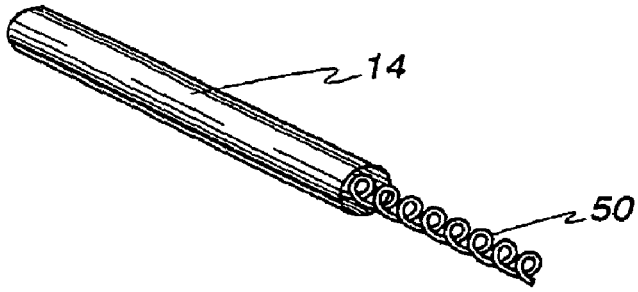
FIG. 3 is an enlarged, fragmentary view of a water tube employed in one embodiment of the invention.

FIG. 3 illustrates a preferred construction for the water tubes 14. A spring wire turbulator 50 extends generally the length of each of the tubes 14. The spring wire turbulator 50 is basically a wire helix with spaced convolutions and induces turbulence in the water flowing within the water tubes 14 which in turn will enhance heat transfer.

Figure 4:
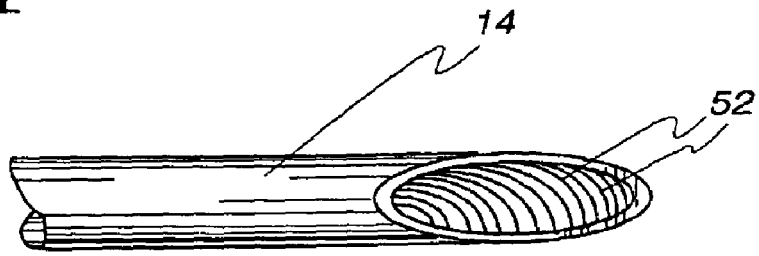
FIG. 4 is a fragmentary view of a water tube employed in another embodiment of the invention.

As an alternative to the use of a turbulator such as the spring wire turbulator 50, the inner wall of the water tubes 14 may be provided with a conventional heat transfer enhancement in the form of multiple, small grooves 52 formed on the interior of the tube wall. This embodiment is illustrated in FIG. 4.

Figure 5:
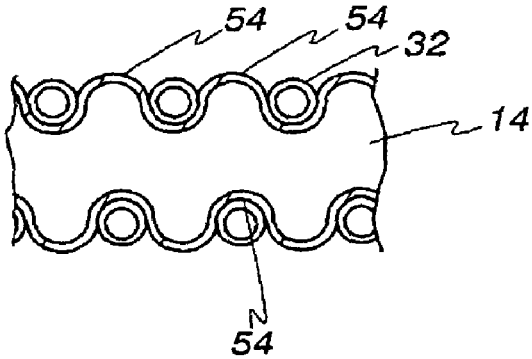
FIG. 5 is a sectional view of still another embodiment of the invention, and specifically the water tube in gas tube relationship in such embodiment.

In some cases, where improved heat transfer between the gas tubes 32 and the water tubes 14 is desired, the latter are provided with a helical pattern of grooves 54 which receive corresponding convolutions of the helical part of each of the gas tubes 32 as shown in FIG. 5. Again, it is preferred that the gas tubes 32 be metallurgically bonded to the water tubes 14 within the grooves 54.

The embodiment of the invention shown in FIG. 5 contemplates that both the water tubes 14 and the gas tubes 32 have a basically circular cross section and as a consequence, it will be appreciated that very nearly 180° of the periphery of each convolution of the gas tube 32 will be in contact with the exterior wall surface of the corresponding water tube 14 thereby maximizing the area over which heat transfer may occur.

In general, the water tubes 14 can be of three types. In the embodiment shown in FIG. 1, a smooth walled tube (both inner and outer wall surfaces are smooth) with the internal spring turbulator 50 is employed. The tube 14 will typically have an inside diameter in the range of about 0.10 inches to 0.40 inches. The helically formed spring wire turbulator 50 will have a diameter of 0.03 inches to 0.08 inches. The pitch of the convolutions of the turbulator 50 will be in the range of 0.20 inches to 1.0 inch.

Where water tubes such as that shown in FIG. 5 are employed, the same dimensions are employed and may include the spring turbulator 50 although the same is not illustrated in FIG. 5.

When the embodiment illustrated in FIG. 4 is used for the water tubes 14, the tube 14 has a smooth exterior wall and an inside diameter in the range 0.14 inches to 0.50 inches.

The gas tubes 32 are preferably smooth walled (both inner and outer wall surfaces are smooth) with an inside diameter of 0.04 inches to 0.10 inches. The pitch of the helical section of the gas tubes 32 will be in the range of 0.20 inches to 2.0 inches. Of course, in the FIG. 5 embodiment, the pitch of the grooves 54 in the tube 14 will be the same as the pitch of the helically wound part of the gas tubes 32.

In one example of a heat exchanger made according to the invention and used as a water heater/$CO_2$ cooler, for an incoming water temperature of 50° F. and an incoming $CO_2$ temperature of 250° F. and at a pressure of 1600 psia, a heat transfer effectiveness of 95% can be obtained with a construction employing a water tube 14 having an inside diameter of 0.19 inches, a spring wire turbulator diameter of 0.051 inches, a spring wire turbulator pitch of 0.25 inches with the water entering at a Reynolds number of about 1,000. The gas tube or $CO_2$ tube 32 will have an inside diameter of 0.08 inches and a pitch of 0.30 inches. $CO_2$ flow entering the tubes 32 should be at a Reynolds number of about 130,000.

Figure 6:
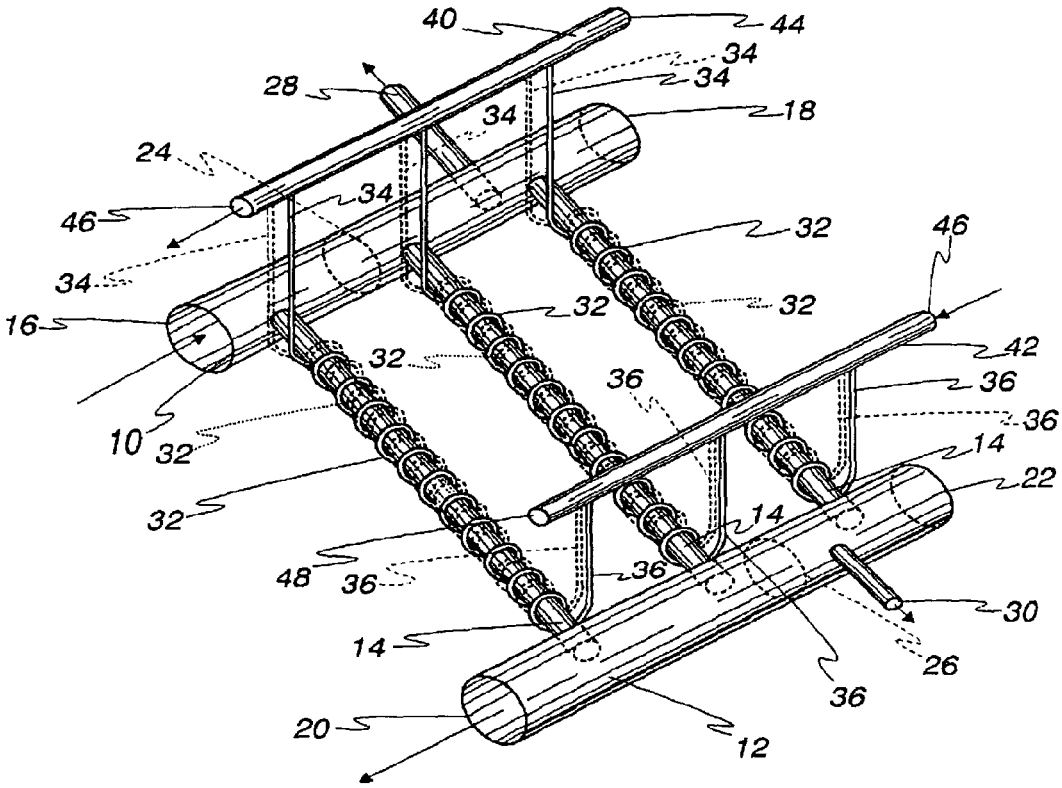
FIG. 6 is a perspective view of another embodiment of a heat exchanger made according to the invention.

It should be appreciated that while the embodiments discussed above describe one preferred arrangement wherein there is a one-to-one correspondence between the gas tubes 32 and the water tubes 14, in some applications it may be desirable to have one or more of the gas tubes 32 helically wound about each of the water tubes 14. This can be desirable, for example, when a lower pressure drop is desired for the gas flow through the gas tubes 32 and/or an increased amount of gas flow is required through the gas tubes 32 to improve the performance of the water heater/gas cooler. One example of this construction is shown in FIG. 6 wherein there are two of the gas tubes 32 for each of the water tubes 14, with the second set of gas tubes 32 shown by dashed lines for purposes of clarity. In all other respects, the heat exchanger of FIG. 6 is identical to the exchanger of FIG. 1 as described above. It should be understood that such a construction can be applied to any of the above-described embodiments, such as for example, the embodiment shown in FIG. 2, wherein one or more additional gas tubes 32 can be wound about the water tube 14.

From the foregoing, it will be appreciated that a relatively simple design of a heat exchanger is provided which allows assembly by brazing and/or soldering. Wall thickness of the gas tubes 32 will be dependent upon the pressure that they must withstand for any given inside diameter in the specified ranges. Suitable fixturing can be readily brazed or soldered to the ends of the header tubes servicing as inlets and/or outlets as well as to the additional outlets provided. As a consequence, heated potable water may be readily supplied relatively inexpensively by capturing the heat that would ordinarily be rejected from the hot gas and utilizing the same to heat water. The use of plural outlets at different locations allows the desired water temperature to be selected without affecting the operation parameters on the gas side of the system.

What is claimed is:

1. A water heater/gas cooler comprising:

first and second generally parallel, spaced, tubular water headers;

a plurality of water tubes extending in spaced, generally parallel relation between said water headers and in fluid communication therewith;

a water inlet in one of said water headers;

a water outlet in one of said water headers;

a plurality of gas tubes, at least one for each water tube, each of said gas tubes helically wound about a corresponding one of said water tubes in heat transfer facilitating contact therewith, each gas tube having opposed ends;

first and second, generally parallel, spaced gas headers connected in fluid communication with respective ones of said opposed ends of said gas tubes;

a gas inlet in one of said gas headers; and a gas outlet in one of said gas headers.

2. The water heater/gas cooler of claim 1 further including at least one additional outlet in at least one of said water headers.

3. The water heater/gas cooler of claim 2 further including at least one baffle in at least one of said water headers.

4. The water heater/gas cooler of claim 1 further including a non-straight turbulator wire in said water tubes.

5. The water heater/gas cooler of claim 4 wherein said turbulator wire is a helically shaped wire.

6. The water heater/gas cooler of claim 1 wherein said water tubes are generally straight and said water headers are remote from one another.

7. The water heater/gas cooler of claim 1 wherein said water tubes are bent to bring said water headers into proximity to one another.

8. The water heater/gas cooler of claim 1 wherein said gas and water tubes are formed of a metal selected from the group consisting of copper and stainless steel.

9. The water heater/gas cooler of claim 1 wherein the interior of said water tubes is grooved.

10. The water heater/gas cooler of claim 1 wherein the exterior of said water tubes has a helical groove, and the gas tubes are wound in said grooves.

11. The water heater/gas cooler of claim 10 further including a non-straight turbulator wire in said water tubes.

12. The water heater/gas cooler of claim 11 wherein said turbulator wire is a helically shaped wire.

13. The water heater/gas cooler of claim 1 wherein each said gas tube has an inside diameter in the range of about 0.04 inch to 0.1 inch.

14. The water heater/gas cooler of claim 13 wherein said inside diameter is about 0.08 inch.

15. The water heater/gas cooler of claim 1 wherein said water tubes have an inside diameter in the range of about 0.10 inch to 0.50 inch.

16. The water heater/gas cooler of claim 15 wherein said water tubes include an internal spring wire turbulator having a diameter in the range of about 0.03 inch to 0.08 inch and a pitch in the range of about 0.20 inch to 1.0 inch and said water tube inner diameter is in the range of about 0.10 inch to 0.40 inch.

17. The water heater/gas cooler of claim 16 wherein said water tubes are smooth walled.

18. The water heater/gas cooler of claim 16 wherein said water tubes each have a helical groove in which a corresponding one of said gas tubes is snugly received, each said helical groove having a pitch in the range of about 0.20 inch to 2.0 inch.

19. The water heater/gas cooler of claim 15 wherein said internal diameter of said water tube is in the range of about 0.14 inch to 0.50 inch and has a grooved inner wall surface.

20. The water heater/gas cooler of claim 1 wherein there are at least two of said gas tubes helically wound about a corresponding one of said water tubes.

21. The water heater/gas cooler of claim 1 wherein there is a one-to-one correspondence between the gas tubes and the water tubes with each of said water tubes having only one of said helically wound gas tubes.

* * * * *